United States Patent [19]

Iimura

[11] Patent Number: 4,702,506

[45] Date of Patent: Oct. 27, 1987

[54] MAGNET CATCHER FOR DOORS

[76] Inventor: Kyosuke Iimura, 1-2-13, Higashi-Tabata, Kita-ku, Tokyo, Japan

[21] Appl. No.: 683,652

[22] Filed: Dec. 19, 1984

[30] Foreign Application Priority Data

| | | | |
|---|---|---|---|
| Jun. 29, 1984 | [JP] | Japan | 59-96740[U] |
| Aug. 24, 1984 | [JP] | Japan | 59-128277[U] |
| Oct. 30, 1984 | [JP] | Japan | 59-164437[U] |
| Nov. 14, 1984 | [JP] | Japan | 59-171741[U] |

[51] Int. Cl.[4] ..... E05C 19/16

[52] U.S. Cl. ..... 292/251.5; 292/DIG. 4

[58] Field of Search ..... 292/251.5, DIG. 4

[56] References Cited

U.S. PATENT DOCUMENTS

| | | | |
|---|---|---|---|
| 2,888,291 | 5/1959 | Scott et al. | 292/251.5 |
| 2,935,352 | 5/1960 | Heppner | 292/251.5 |
| 2,935,353 | 5/1960 | Loeb | 292/251.5 |
| 3,163,453 | 12/1964 | Stephens | 292/251.5 |
| 3,186,748 | 6/1965 | Foltz | 292/251.5 |
| 3,351,368 | 11/1967 | Sweet | 292/251.5 |
| 4,270,781 | 6/1981 | Nishimura | 292/251.5 |

FOREIGN PATENT DOCUMENTS

| | | | |
|---|---|---|---|
| 1534621 | 6/1968 | France | 292/251.5 |
| 823797 | 11/1959 | United Kingdom | 292/251.5 |

*Primary Examiner*—Lloyd A. Gall

*Attorney, Agent, or Firm*—Holman & Stern

[57] ABSTRACT

A magnet catcher is used in closing and opening of a door of an audio rack and other cabinets and includes a magnetic stop member mounted on a door. A frame-mounted casing supports a movable member which magnetically retains the stop member when in contact with it. The casing includes a guide recess for guiding a yolk portion of the movable member to permit tilting of the yolk portion. A spring biases the movable member to a position outward of the casing. A rod fixed to the casing has an end guided by the movable member, so as to cause the yolk portion of the movable member to tilt when the door is being opened due to movement of the rod relative to the movable member. As the yolk portion tilts, the magnetic contact area is greatly reduced, and separation of the yolk portion from the stop member is facilitated.

3 Claims, 17 Drawing Figures

MAGNET CATCHER FOR DOORS

BACKGROUND OF THE INVENTION

Magnets and springs are widely used in a door open/-close devices for cabinets for audio systems and other cabinets. Such devices comprise a movable body with a magnet attached to one end thereof which is engaged when pushed and returns to the initial position when further pushed to release the engagement, and includes an attractable piece to be attracted by said magnet, the movable body and the attractable piece being respectively attached to the main body of a box and a door. When a door of such a cabinet is pushed toward the main body, a free end of said door projects to push away the main body and when the door is pulled outward by a hand, the magnetic engagement between the piece and the magnet is released to fully open the door. Alternatively, the door is pushed open by the movable body.

However, the door closing device of the above type is structured to prevent the door from opening by vibration or slight impact. As the door often stops in the state magnetically attracted to the movable body even if the free end of the door is projected (opened), it is necessary to open it further by hand. In the latter type of the above mentioned device, the movable body has to keep enough projecting (opening) force to thrust open the door by inertia. In the case where the door is made of acrylic material or thin glass, or an opening of the cabinet is small, or of a double-leaf door, as the door has small intertia, an intense or sharp pushing force is required. However, if the pushing force is increased, it would give an unpleasant sound. Furthermore, vibration in the cabinet caused by pushing is disadvantageous since the needle may skip to damage the disc when being played or it may damage the audio system. If a larger-sized open/close device is required to withstand such vibration, it may lead to a higher cost.

There has been proposed a device which enables a door to open with smaller force on a movable body by making yokes on both sides of a magnet to project in the direction of the door to thereby reduce the magnetic lines of force. However, in such a device, it is required to slide the yokes against the attracting force of the magnet, which requires a larger device and thus leads to a higher cost. In another device comprising a cylindrical magnet and an arc yoke along the outer peripheral of said magnet, the magnet force of the yoke is reduced by turning the yoke to a neutral position. However, disadvantages such as a higher cost of the device as in the former type due to the friction resistance at the time of turning are also noted in this device.

As shown in FIGS. 15 through 17, prior art magnet catchers are shown having a movable body (101) which has a magnet attaching hole (103) open to both sides and a slit (106) on the front end thereof from which only the front end of a yoke (105) projects, the yoke being attached to a magnet (104) which is mounted in said magnet attaching hole (103), and an endless guide channel (108) is provided on the rear upper surface to receive a bent end (107*a*) of an engaging pin (107) which connects the movable body (101) and a case (102). A recess channel (110) is provided on the rear lower surface for receiving a coil spring (109). A fitting part (111) extending on both sides for fixing the case is projectedly installed on the case (102), in the rear end of which a through-hole (112) for said pin (107) is bored. A flanged projection (113) is provided to engage with the bent end (107*b*) of the pin (107). The projection (113) has U-shaped channel (114) adjacent to the through-hole (112) to correspond thereto. On the bottom of the channel (114) is bored a hole (115) to which the end (107*b*) of the pin (107) is inserted.

Therefore, in integral molding of a movable body (101) with synthetic resin, it is necessary to use a mold with five parts movable in the directions indicated as shown (by the arrows X—X), in FIGS. 16 and 17, which is open in the top, bottom, left, right and the front. That results in a higher cost and a troublesome manufacturing process which may sometimes yield defective products.

SUMMARY OF THE INVENTION

The magnet catcher for closing the door according to the present invention is proposed to obviate the above disadvantages. The first object of the invention is to provide a magnetic closed circuit which yields a strong attraction between the contacting faces of an attractable piece attached to a door and the front end of yokes attached to both faces of a magnet of an open/close device when the door is open, and to reduce the magnetic line of force passing the attracting face of the yoke front end by inclining the yoke front end of a movable body in respect to the attractable piece, thereby causing the inertia of the door to easily detach the door from the yoke front end to open. The second object of the invention is to prevent the vibration otherwise caused at the time of thrusting from giving an adverse effect on the box body or the device. The third object of the invention is to enable the door to open without further pushing by a hand so that there will be no need for a larger device or a higher cost. The fourth object is to lower the manufacturing cost by reducing the number of molds used in the integral molding of synthetic resin.

DETAILED DESCRIPTION OF THE INVENTION

The present invention will now be described in detail referring to embodiments shown in the attached drawings.

Figure 1:
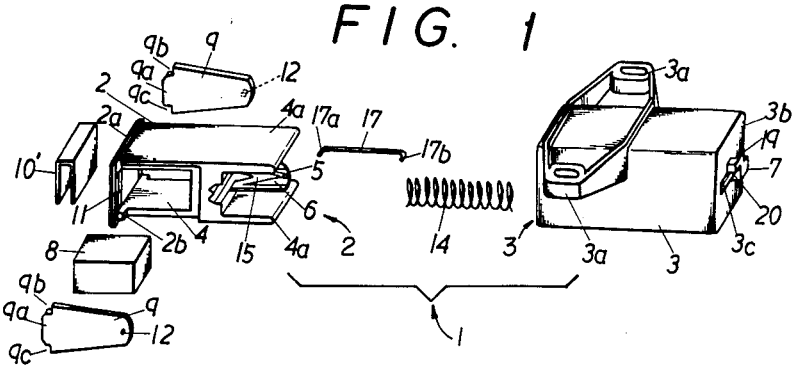
FIG. 1 is an exploded perspective view of an embodiment of a magnet catcher according to the present invention.
Figure 2:
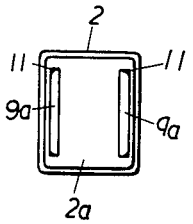
FIGS. 2 and 3 are respectively a side view and a front view of the movable body 2 of said magnet catcher.

In FIG. 1, reference number 1 denotes a magnet catcher, 2 a movable body, and 3 a case into which the movable body 2 is fitted in a freely slidable manner. All of these components are made of synthetic resin.

The movable body 2 is of square column shape and a magnet attaching hole 4 is bored on the front portion whereas a spring attaching rod 5 is projected between side walls 4*a*. One face of rod 5 is a flat face 6. The flat face 6 runs parallel to an opening surface of the hole 4, so that the hole 4 and the flat face 6 can be made from one mold.

The case 3 2 has a projected fitting part 3*a* extending on both sides, the front end of which is opened and the rear end of which 3*b* is provided with a pin engaging part 7 and a long hole 3*c* for inserting a pin is bored.

An L-shaped projection 19 along the circumference of the long hole 3*c* is provided in the rear end 3*b* face of the part 7 and a hole 20 extending from the outside to its inside of the L-shaped bent part is bored in the base of said projected part 19 and along the shorter side of the long hole 3*c* to engage with an end of the pin 17.

Figure 10:
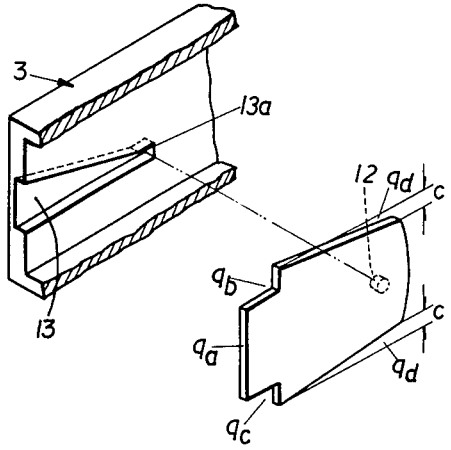
FIG. 10 is a perspective view of a yoke and a channel inside the case.

A permanent magnet 8 is inserted into the magnet attaching hole 4 of the movable body 2, on either side of which is provided with a yoke 9 respectively. Shoulders 9*b* and 9*c* having a notched end portion on the top and bottom surface are provided on the front end 9*a* of the yokes 9. The front ends 9*a* are inserted into two slits provided in parallel to the front end 2*a* of the movable body 2 so that these front ends 9*a* protrude slightly from the front end 2*a* of the movable body 2 to form attracting faces. Each yoke 9 has a projection 12 in the rear end of the outer side to fit into a tapered recess channel 13 in the case 3 (as seen in FIG. 10) which is defined on both sides by a side parallel to the axial line of the case 3 and by a side inclined toward the center rear end.

A non-inclining part 13*a* of a shorter dimension is provided in the rear end of the channel 13.

A thick part 2*b* on which one side of the shoulder 9*c* of the yoke 9 abuts is provided in a manner that one shoulder 9*c* engages with said thick part 2*b* when the yoke 9 advances while another shoulder 9*b* makes the yoke 9 inclined as it is left unengaged, thereby inclining the front end 9*a* protruded from the slit 11.

The both sides of the top and bottom of the yoke 9 are so formed to avoid contact with the inside bottom wall of the movable body 2 when the yoke 9 is inclined by providing a triangular relief notched in the width c (shown in FIG. 10) from the end of the shoulders 9*b* and 9*c* of the front end 9*a* to each rear end of the yoke 9, thereby allowing an easier inclining movement of the yoke 9.

Figure 8:
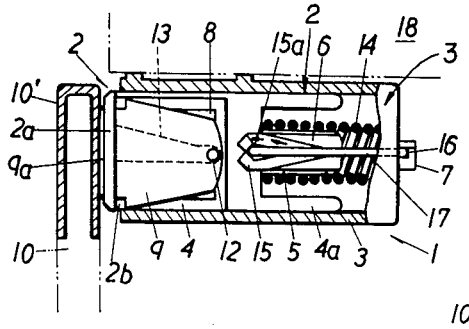
FIG. 8 is a partially sectioned side view showing the closed state of the door.

A coil spring 14 is inserted between said rod 5 and the rear side of the case to energize the movable body 2 forward against the case 3. An endless guide channel 15 provided with an M-shaped part having an engaging part 15*a* on the front end and a V-shaped part having an engaging part 15*b* on the rear end is formed on one face 6 of the rod 5. A hole 16 is provided in the pin engaging part 7 at the rear end of the case 3 and an engaging pin 17 both ends of which form L-shaped bent ends 17*a* and 17*b* is inserted into said hole 16 and said endless guide channel 15 via the long hole 3*c* at the rear end of the case 3. One bent end 17*a* is slidably inserted into the endless guide channel 15 whereas the other bent end 17*b* is inserted into the hole 16. Magnet catcher 1 (shown in FIG. 8) is attached onto a door frame 18 by the fitting part 3*a* at both sides of the case 3 and an attractable piece 10' is attached to the prescribed position of the door 10.

When the door is closed, the movable body 2 is housed in the case 3. The front end 9*a* of the yoke 9 is parallel to the front edge 2*a* of the movable body 2 as well as with the attracting face of the attractable piece 10' and is completely attracted to the attractable piece 10'. To open the door, the door 10 in the closed state is further pushed in the closing direction. This makes the movable body 2 recede overcoming the resistance of the spring 14. The projection 12 of the yoke 9 initially recedes into the non-inclining part 13*a* of the channel 13 (shown in FIG. 10) so that the front part of the movable body 2 protrudes from the case 3 by the action of the spring 14 when the door 10 is opened. This opening permits the yoke 9 to advance to thereby move the projection 12 of the yoke 9 through the channel inside the case 3 to the wider part at the edge of the case 3.

On the other hand, the door 10 is pushed forward by the movable body 2 until it is stopped by the engagement with the pin 17. However, the door 10 continues to move in the open direction by inertia and the yoke 9 attracted to the attractable piece 10' of the door 10 also moves works to protrude from the movable body 2 together with the moving door 10. One of the shoulders 9*c* abuts against the thick part 2*b* of the movable body 2 to be restricted in the movement while the other shoulder 9*b* which is kept free makes the yoke 9 inclined. Thus the front end 9*a* is inclined against the surface of the attractable piece 10' to change the contact between these two from surface contact to point contact. (refer to FIGS. 9 and 12).

The attracting magnetic force is generally determined by the strength of the magnet used and can be measured as the number of magnetic force lines per unit area, but there is an upper limit. Furthermore, the attracting force decreases in inverse proportion to the square of the distance between the attracting faces. Therefore, the attracting force between the parts which are pushed away from each other by the above operation is reduced and the contacting area decreases to a point, further reducing the attracting force.

Figure 9:
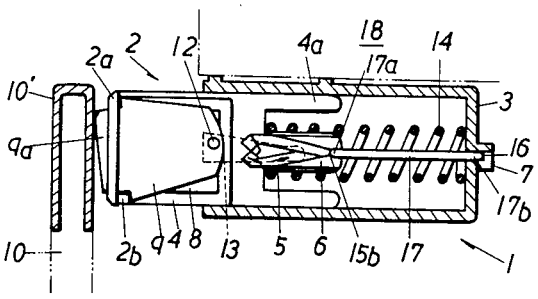
FIG. 9 is another side view partially sectioned to show the opened state of the door.

Projection of said movable body 2 is stopped when the bent end 17*a* of the pin connecting the movable body 2 and the case 3 moves in the direction shown by the arrow in FIG. 9 to reach the V-shaped engaging point 15*b*. The door 10 is easily detached to open by inertia from the yoke front end 9*a* as its attacting force is reduced.

When the door 10 is pushed in the closing direction, the attractable piece 10' abuts on the angular part of the inclined yoke front end 9*a* to push the movable body 2 into the case 3 against the spring 14, and the projection 12 of the yoke 9 moves into the channel 13 to reach the non-inclining part 13*a* on the rear end, thereby returning the yoke 9 to the initial position in the initial posture. As a result, the surface of the yoke front end 9*a* becomes parallel to the surface of the attracting piece 10' to increase the attracting area and thus the attracting force. The bent end 17*a* of the pin 17 moves in the direction marked by the arrow in FIG. 8 to reach an M-shaped engaging point 15*a* and to place the movable body in a fixed state into the case, thereby closing the door.

Figure 12:
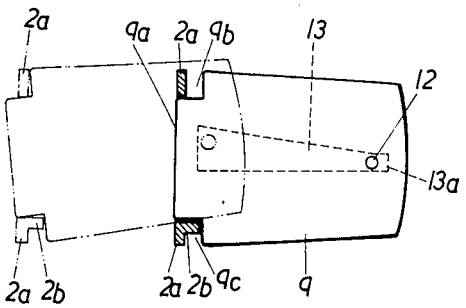
FIGS. 11 and 12 respectively are a front view and an operational explanatory view of the yoke.
Figure 11:
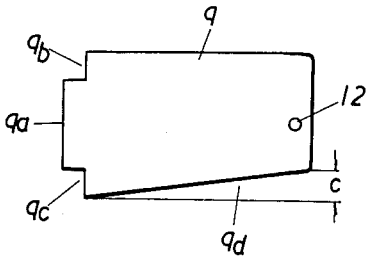

The yoke 9 is prepared to be attached on either side of a magnet 8 in the above embodiment to simplify assembling work as well as saving cost in molding. FIG. 11 shows another embodiment wherein a relief 9*d* is provided only on one side of the yoke on each inclining side thereof so that when the door is closed, the other side of the yoke 9 abuts on the opening side end of the hole 4 to stabilize the position of the yoke 9. FIG. 12 illustrates operation of the yoke 9 of FIG. 11.

Figure 13:
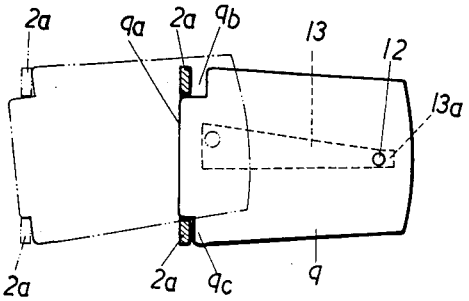
FIG. 13 is an explanatory view of the operation of a yoke in another embodiment of this invention.

FIG. 13 shows still another embodiment of this invention wherein one shoulder 9*b* is notched deeper than the other shoulder 9*c* and the front end 2*a* of the movable body is not formed thick. When the front end 9*a* of the yoke projects, one of the shoulders 9*b* abuts against the inner face of the front end 2*a* of the movable body 2 to make the yoke 9 inclined, thereby inclining the front end 9*a* against the attracting piece 10' of the door 10.

Figure 14:
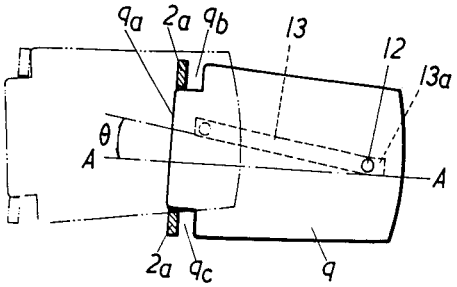
FIG. 14 is an explanatory view of the operation of the yoke in still another embodiment of this invention.
Figure 15:
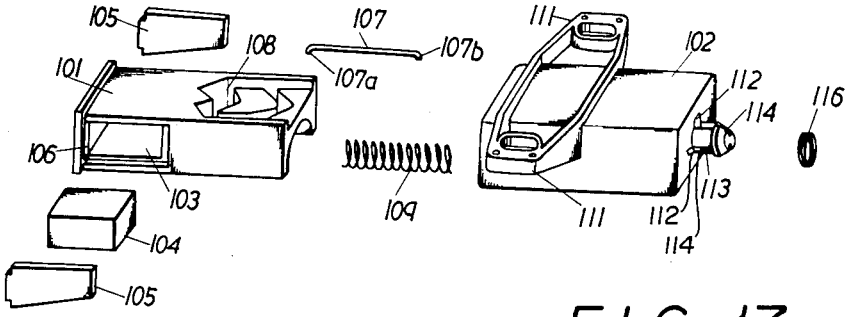
FIG. 15 PRIOR ART
FIG. 15 is an exploded perspective view of a prior art device.
Figure 16:
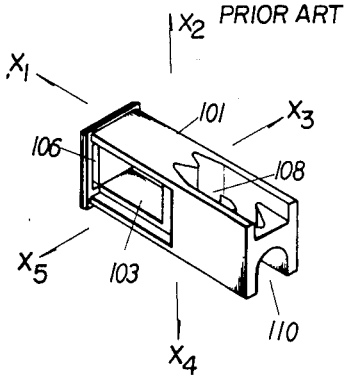
FIG. 16 PRIOR ART
FIG. 16 is a perspective view of a movable body thereof.

In a still another embodiment of this invention shown in FIG. 14, the shoulders 9*c* and 9*b* on both top and bottom of the front end 9*a* of the yoke 9 are similarly notched, but the channel 13 inside the case is inclined at a predetermined angle $\theta$ in respect of the axial line A—A of the case 3 to serve as a guide for sliding the projection 12 of the yoke 9 therein. In this embodiment like the one shown in FIG. 11, a relief 9*d* is notched on only one side so as to stabilize the yoke 9 when the door is opened.

The inclined guide channel 13 is provided with a smaller and non-inclined channel 13*a* on the rear end thereof. Such a channel may be prepared by molding a groove defined on both sides by a side parallel to the axial line A of the case and by an inclining side and then after removed from a mold, attaching a wedge piece on it to obtain a predetermined shape of the channel.

Figure 3:
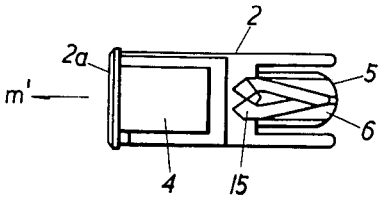
Figure 4:
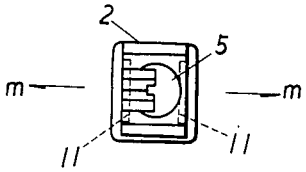
FIG. 4 is a side view of the movable body seen from the other direction.
Figure 5:
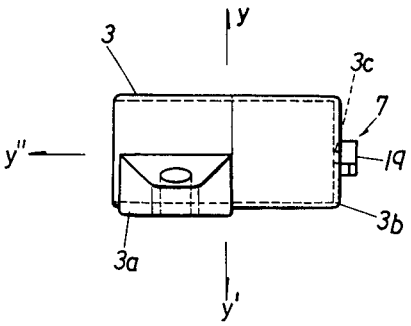
FIGS. 5 and 6 respectively are a front and a side views of the case of said movable body.
Figure 6:
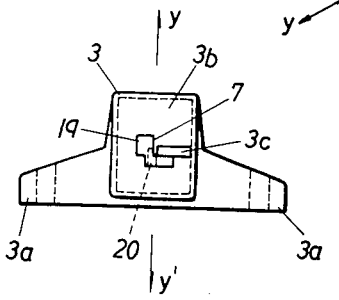

The magnet catcher 1 according to this invention is so structured that one face of the rod 5 is the flat face 6. The flat face 6 runs parallel to an opening surface of the hole 4, so that the hole 4 and the flat face 6 can be made from one mold. In order to integrally mold such structure, there is required only three molds, i.e. the two molds which separate in the directions shown by the arrows m—m in FIG. 4 and the mold which separates in the direction shown with the arrow m' in FIG. 3 and which opens a slit. In order to mold the case 3, only three molds are needed, i.e. the two molds which separate in the directions shown with the arrows y,y' in FIG. 6, the upper mold thereof and the lower mold having a projection to form a hole 20 of the engaging portion 7, and the one which is to be removed in the direction shown with the arrow mark and which is to form a hollow portion and an elongated hole 3*c*.

Figure 17:
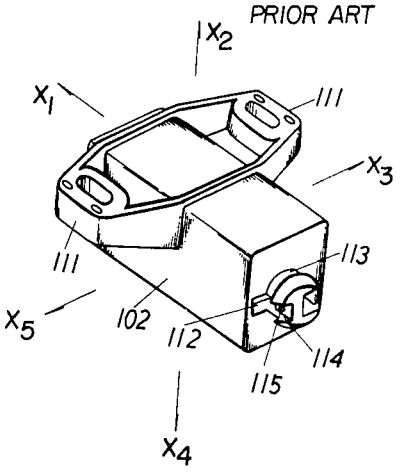
FIG. 17 PRIOR ART
FIG. 17 a perspective view of a case thereof.

Generally speaking, customers prefer the type of a magnet catcher wherein the front end of the yoke 9 is perpendicular to the surface where the case is mounted. When the movable body shaped according to this invention is assembled within a case having an engaging point for the pin in conventional forms, it is necessary to mold the case to have an engaging point rotated by 90° from conventional position. In such a case, there may require five molds (not shown) assembled or movable in the directions indicated by the arrows $X_1$–$X_5$ as shown in FIG. 17. But generally only three molds would suffice in molding the engaging point according to this invention.

Figure 7:
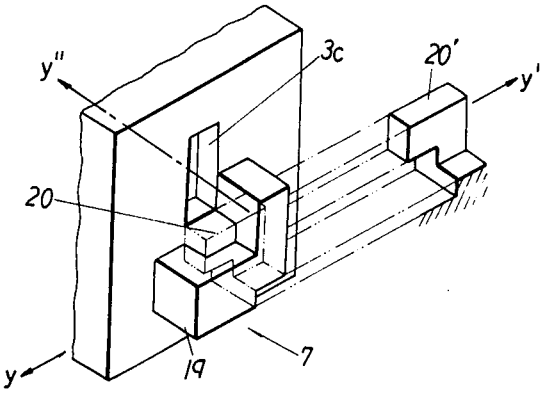
FIG. 7 is a perspective view showing an engaging part of the pin in said case 3.

As seen in FIG. 7, a part 20' of the mold is seen as part of a larger mold portion which is broken away for clarity.

As described in the foregoing, the magnet catcher according to this invention comprises a magnetic closed circuit in a manner that an attracting piece mounted on a door is firmly attracted in surface contact to the front end of the yoke mounted on a box. For opening the door, a movable body projects with a spring force to incline the yoke front end surface in respect of the attracting piece to thereby change the contact therebetween from surface to point. This reduces the magnetic force to help the detachment of the door from the front end of the yoke by the inertia of the door per se when the movable body is stopped. The magnet catcher according to this invention enables the door to open without intensive projecting force which might otherwise cause uncomfortable sound or vibration. As the device can be made compact, it does not entail a higher cost. Further, as the number of molds necessary for molding process is drastically reduced, the cost may be remarkably lowered.

What is claimed is:

1. A magnet catcher for a door, comprising:

a case, and a movable body disposed inside said case in a freely slideable manner; and a magnet having at least two opposed sides;

said movable body having a front end and a magnet housing; said magnet housing having an opening containing said magnet with said two opposed sides of said magnet being exposed;

said movable body and said case together supporting a yoke, said yoke being movable relative to said movable body and said case;

said yoke having a projecting front end;

said yoke including at least one yoke member disposed adjacent a first one of said at least two opposed sides of said magnet which are exposed by said opening; said yoke member having a rear portion; said rear portion of said yoke member having a projection thereon on a side of said yoke member which faces away from said first side of said magnet;

said case having a pair of sidewalls; a first one of said sidewalls having a recessed portion adapted to receive said projection of said yoke member; said first one of said sidewalls guiding movement of said movable body;

said recessed portion having a narrow end adapted to snugly receive said projection and a wide end;

slits disposed in said front end of said movable body adapted to receive said projecting front end of said yoke; said projecting front end of said yoke having a first position corresponding to a retracted position of said movable body within said case wherein said projecting front end is in contact with a magnetically attractable body along a substantial portion of a perimetry of said projecting front end of said yoke; in a second position of said yoke, corresponding to an extended position of said movable body from within said case, an attracting surface of said projecting front end of said yoke in said second position being inclined relative to said first position of said yoke when said movable body is in said first position during attaching and detaching of said yoke to said magnetically attractable body; said projecting front end of said yoke being notched to have shoulders thereon, said projecting front end of said yoke being disposed within said slits;

a rod having a generally flat face disposed adjacent an end of said body, said generally flat face having an endless guide channel which engages with a pin;

said case having a spring engaging portion on a rear end thereof, so that said spring engaging portion engages with one end of said pin while another end of said pin is engaged within said endless guide channel of said generally flat face; a coil spring urging said movable body outward from said case;

during movement of said movable body from said first position to said second position, said projection on said yoke member being in said wider portion of said recess, thereby permitting tilting movement of said yoke relative to said movable body and to said case;

whereby opening of a door results in tilting of said yoke relative to said movable body to reduce magnetic contact area of said yoke relative to said magnetically attractable body.

2. A magnet catcher for a door as claimed in claim 1, wherein an endless guide channel is disposed on said movable body on an outer peripheral surface thereof generally parallel to an axis of said rod.

3. A magnet catcher for a door as claimed in claim 1, wherein upon movement of said case relative to said magnetically attractable body which comprises a stop member connected to a door, said yoke tilts from said first position to said second position under action of said rod as said yoke is extended from said case due to magnetic attraction of said yoke to said stop member;

tilting of said yoke from said first position to said second position acting to reduce magnetic contact between said yoke and said stop member from a relatively large region of contact to a greatly reduced region of contact so that magnetic attraction between said yoke and said stop is greatly diminished;

whereby movement of the door away from said yoke is relatively smooth.

* * * * *